US006007679A

United States Patent [19]

Nagarajan et al.

[11] Patent Number: 6,007,679

[45] Date of Patent: Dec. 28, 1999

[54] PAPERMAKING PROCESS

[75] Inventors: R. Nagarajan, Naperville; Jane B. Wong Shing, Aurora, both of Ill.

[73] Assignee: Nalco Chemical Company, Naperville, Ill.

[21] Appl. No.: 09/172,568

[22] Filed: Oct. 14, 1998

Related U.S. Application Data

[63] Continuation-in-part of application No. 08/845,795, Apr. 25, 1997, which is a continuation of application No. 08/641,671, May 1, 1996, abandoned.

[51] Int. Cl.[6] ..... D21H 21/10

[52] U.S. Cl. ..... 162/168.3; 162/181.6; 162/181.8; 162/183

[58] Field of Search ..... 162/168.1, 168.3, 162/158, 183, 181.6, 181.8

[56] References Cited

U.S. PATENT DOCUMENTS

| | | | |
|---|---|---|---|
| 4,388,150 | 6/1983 | Sunden et al. | 162/175 |
| 4,753,710 | 6/1988 | Langley et al. | 162/168.2 |
| 4,913,775 | 4/1990 | Langley et al. | 162/168.2 |
| 4,929,655 | 5/1990 | Takeda et al. | 524/458 |
| 5,006,590 | 4/1991 | Takeda et al. | 524/458 |
| 5,098,520 | 3/1992 | Begala | 162/168.2 |
| 5,185,062 | 2/1993 | Begala | 162/168.2 |

FOREIGN PATENT DOCUMENTS

| | | |
|---|---|---|
| 2180404 | 1/1997 | Canada . |
| 202780 | 11/1986 | European Pat. Off. . |
| 277728 | 8/1988 | European Pat. Off. . |
| 57-77399 | 5/1982 | Japan . |
| 59-137600 | 8/1984 | Japan . |
| 61-6397 | 1/1986 | Japan . |

*Primary Examiner*—Peter Chin
*Attorney, Agent, or Firm*—Margaret M. Brumm; Thomas M. Breininger

[57] ABSTRACT

The invention relates to a paper making process in which improved drainage and retention is obtained by the addition of an effective amount of a cationic dispersion polymer to an aqueous cellulosic paper making slurry prior to shearing the slurry; which cationic dispersion polymer is selected from a group of copolymers consisting of:

i) a copolymer of about 10 mole % DMAEA.BCQ and about 90 mole % AcAm;

ii) a copolymer of about 10 mole % DMAEA.MCQ and about 90 mole % AcAm; and iii) a copolymer of about 20 mole % DMAEA.MCQ and about 80 mole % AcAm; and adding to the slurry, after said cationic dispersion polymer is added and the slurry is sheared, a microparticle selected from the group consisting of a) copolymers of acrylic acid and acrylamide;

b) bentonite; and c) dispersed silica.

21 Claims, 7 Drawing Sheets

PAPERMAKING PROCESS

CROSS-REFERENCE TO RELATED APPLICATIONS

This application is a continuation-in-part of U.S. patent application Ser. No. 08/845,795, filed Apr. 25, 1997, now pending; which is a continuation of U.S. patent application Ser. No. 08/641,671, filed May 1, 1996, now abandoned.

FIELD OF THE INVENTION

The present invention is in the technical field of papermaking. More specifically, this invention is in the technical field of wet-end additives to papermaking furnish.

BACKGROUND OF THE INVENTION

Retention and drainage are two important properties of a papermaking process that papermakers are always seeking to optimize. The meaning of these two terms is well-known to persons of ordinary skill in the art of papermaking.

One method of improving the retention of cellulosic fines, mineral fillers and other furnish components on the fiber mat is the use of a coagulant/flocculant system, added ahead of the paper machine. To use such a system, a papermaking slurry (or furnish) is created out of a pulp. To this slurry is added a coagulant, with said coagulant being selected from the group consisting of low molecular weight cationic synthetic polymers, starch and alum. The coagulant generally reduces the negative surface charges present on the particles in the slurry, particularly cellulosic fines and mineral fillers, and thereby accomplishes a degree of agglomeration of such particles. The next item added is a flocculant. Flocculants typically are high molecular weight anionic synthetic polymers which bridge the particles and/or agglomerates, from one surface to another, binding the particles into large agglomerates. The presence of such large agglomerates in the slurry as the fiber mat of the paper sheet is being formed increases retention.

While a flocculated agglomerate usually does not interfere with the drainage of the fiber mat to the extent that would occur if the furnish were gelled or contained an amount of gelatinous material, there is a noticeable reduction in drainage efficiency when such flocculated agglomerates are filtered by the fiber web, because the pores thereof are to a degree reduced. Hence, retention usually is increased with some degree of deleterious effect on the drainage.

Another system employed to provide an improved combination of retention and drainage (or dewatering as it is sometime known) is described in U.S. Pat. No. 4,753,710 and U.S. Pat. No. 4,913,775, the disclosures of both of these patents being incorporated herein by reference. In brief, such method first adds to the aqueous cellulosic papermaking suspension a high molecular weight linear cationic polymer before shearing the suspension, followed by the addition of bentonite after shearing. The shearing generally is provided by one or more of the cleaning, mixing and pumping stages of the papermaking process. The shearing breaks down the large flocs formed by the high molecular weight polymer into microflocs. Further agglomeration then ensues with the addition of the bentonite clay particles.

Another system uses the combination of cationic starch followed by dispersed silica to increase the amount of material retained on the web by the method of charge neutralization and adsorption of smaller agglomerates. This system is described in U.S. Pat. No. 4,388,150, inventors Sunden et al., issued Jun. 14, 1983.

In another system, a high molecular weight cationic polymer is added to the slurry before shearing. Then an organic microparticle is added to the slurry after the introduction of shear. The organic microparticle is a medium molecular weight anionic polymer such as the copolymers of acrylic acid described in U.S. Pat. No. 5,098,520, the disclosure of which is incorporated herein by reference. Or the organic microparticle can be a medium molecular weight anionic sulfonated polymers such as those described in U.S. Pat. No. 5,185,062, the disclosure of which is herein incorporated by reference.

There continues to be a need to identify new additive or additives that when added in specific combinations result in improvement in retention and drainage in a papermaking process.

SUMMARY OF THE INVENTION

The claimed invention is: in a papermaking process consisting essentially of:

forming an aqueous cellulosic papermaking slurry;

adding to the slurry certain additives;

shearing the slurry;

draining the slurry to form a sheet; and drying the sheet to form a paper sheet;

the improvement comprising adding to the slurry, prior to it being sheared; an effective amount of a cationic dispersion polymer; which cationic dispersion polymer is selected from a group of copolymers consisting of:

i) a copolymer comprising about 10 mole % dimethylaminoethyl acrylate.benzyl chloride quaternary salt (DMAEA.BCQ) and about 90 mole % acrylamide (AcAm);

ii) a copolymer comprising about 10 mole % dimethylaminoethyl acrylate.methyl chloride quaternary salt (DMAEA.MCQ) and about 90 mole % acrylamide (AcAm); and iii) a copolymer comprising about 20 mole % dimethylaminoethyl acrylate.methyl chloride quaternary salt (DMAEA.MCQ) and about 80 mole % acrylamide (AcAm); and adding to the slurry, after said cationic dispersion polymer is added and the slurry is sheared, a microparticle selected from the group consisting of a) copolymers of acrylic acid and acrylamide;

b) bentonite; and c) dispersed silica.

DETAILED DESCRIPTION OF THE INVENTION

Figure 1:
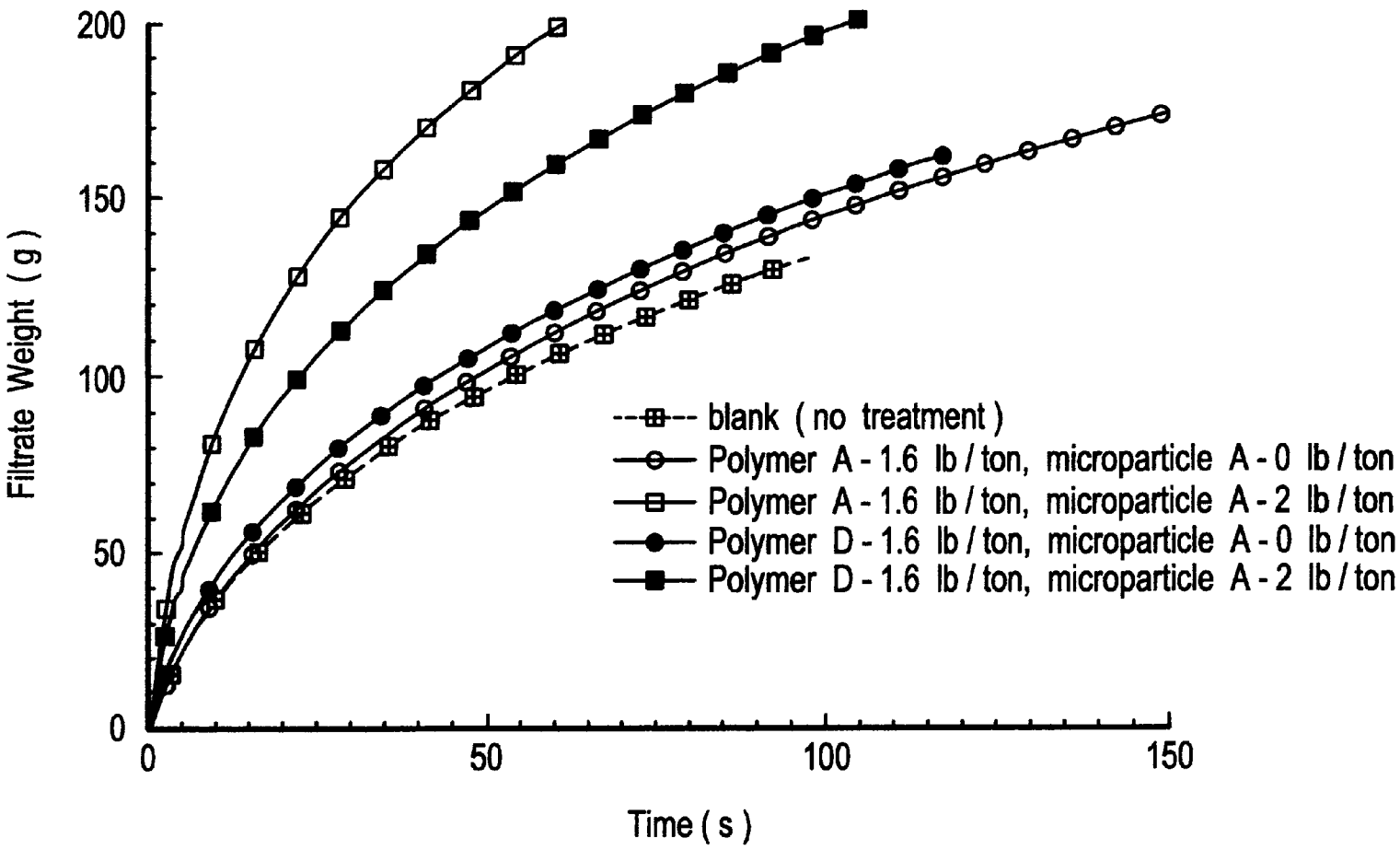
FIG. 1 is a plot of Filtrate Weight vs. Time for an alkaline test stock in which Polymer A and Polymer D are compared, with and without the addition of Microparticle A.

Throughout this patent application, the following definitions will be used: AcAm for acrylamide; DMAEA.BCQ for dimethylaminoethyl acrylate.benzyl chloride quaternary salt; DMAEA.MCQ for dimethylaminoethyl acrylate.methyl chloride quaternary salt; and DADMAC for diallyldimethylammonium chloride.

RSV stands for Reduced Specific Viscosity, which is an indication of polymer chain length and average molecular weight which are indicative of the extent of polymerization during production. The RSV is measured at a given polymer concentration and temperature and calculated as follows:

$$RSV = \frac{[(\eta/\eta_0) - 1]}{c}$$

$\eta$=viscosity of polymer solution $\eta_o$=viscosity of solvent at the same temperature c=concentration of polymer in solution.

In this patent application, the units of concentration "c" are (grams/100 ml or g/deciliter). Therefore, the units of RSV are dl/g. In this patent application, for measuring RSV, the solvent used was 0.125 Molar sodium nitrate solution. The polymer concentration in this solvent was 0.045 g/dl. The RSV was measured at 30° C. The viscosities $\eta$ and $\eta_o$ were measured using a CannonUbbelohde semimicro dilution viscometer, size 75. The viscometer is mounted in a perfectly vertical position in a constant temperature bath adjusted to 30±0.02° C. The error inherent in the calculation of RSV is about 2 dl/grams. When two polymers have similar RSV's that is an indication that they have similar molecular weights.

IV stands for intrinsic viscosity, which is RSV when the limit of concentration is equal to zero.

According to the invention, the first step of the claimed invention is forming an aqueous cellulosic papermaking slurry. Specific cellulosic papermaking slurries are made out of specific papermaking pulps. The present process is believed applicable to all grades and types of paper products, and further applicable for use on all types of pulps including, without limitation, chemical pulps, including sulfate (a.k.a. kraft process pulps) and sulfite(a.k.a. acid process pulps) pulps from both hard and soft woods; thermo-mechanical pulps; mechanical pulps; recycle pulps and ground wood pulps. The preferred pulp employed is selected from the group consisting of chemical pulps and recycle pulps.

The pulp is used to make the aqueous cellulose slurry required to practice the instant claimed invention. Techniques useful to form an aqueous cellulosic papermaking slurry from a pulp are known in the art.

The next step is to add certain additives to the slurry. These selected additives include, but are not limited to, coagulants, one or more sizing agent rosins and one or more mineral fillers. Other additives may be incorporated based on the selection of pulp and desired grade of paper that is being made. The selection of the type of additives useful is within the purview of a person of ordinary skill in the art of papermaking.

Coagulants suitable for this purpose are those known to a person of ordinary skill in the art of papermaking, and include, but are not limited to, low molecular weight cationic synthetic polymers, starch and alum. There are low molecular weight cationic synthetic polymers that are known in the art as being capable of functioning as a coagulant in this process. In a similar manner, there are commercially available starches, such as cationic potato starch, that are capable of functioning as a coagulant in this process. Alum is also commercially available.

Sizing agent rosins suitable to be used in this process are those known to a person of ordinary skill in the art of papermaking.

Mineral fillers are selected from the group consisting of titanium dioxide, clay, talc, calcium carbonate, and combinations thereof. The amount of mineral filler, such as calcium carbonate, generally employed in a papermaking stock is from about 10 to about 30 parts by weight of the filler, as $CaCO_3$, per hundred parts by weight of dry pulp in the slurry, but the amount of such filler may at times be as low as about 5, or even about 2, parts by weight, and as high as about 40 or even 50 parts by weight, on the same basis. One or more mineral fillers may be added to the slurry. The choice of and number of mineral fillers to be added is a decision that a person of ordinary skill in the art of papermaking can make, based upon the type of pulp selected and the final grade of paper desired.

The choice of and amount of certain additives to added to said slurry is dependent upon the pulp and the desired grade of paper to be made. Persons of ordinary skill in the art of papermaking are capable of selecting additives in order to make the desire grade of paper. For example a cationic potato starch can be used as a coagulant for an aqueous papermaking slurry containing a chemical pulp with an alkaline pH; whereas alum can be used as a coagulant for an aqueous papermaking slurry containing a chemical pulp with an acid pH.

Further details on the forming of aqueous cellulosic papermaking slurries can be found in any standard reference text in the art of papermaking. Once such text, is "PAPER BASICS: Forestry, Manufacture, Selection, Purchasing, Mathematics and Metrics, Recycling", by David Saltman, ©1978 by Van Norstrand Reinhold Company, published by Krieger Publishing Company, Krieger Drive, Malabar, Fla. 32950.

The next step in the process is to add to the slurry an effective amount of a cationic dispersion polymer which is selected from a group of copolymers consisting of:

i) a copolymer of about 10 mole % DMAEA.BCQ and about 90 mole % AcAm;

ii) a copolymer of about 10 mole % DMAEA.MCQ and about 90 mole % AcAm; and iii) a copolymer of about 20 mole % DMAEA.MCQ and about 80 mole % AcAm;

Methods of manufacturing cationic dispersion copolymers comprising about 10 mole % DMAEA.BCQ and about 90 mole % are described in U.S. Pat. No. 5,006,590 and U.S. Pat. No. 4,929,655, with both of these patents being incorporated herein by reference.

A cationic dispersion copolymer comprising about 10 mole % DMAEA.BCQ and about 90 mole % AcAm can be purchased from Nalco Chemical Company, One Nalco Center, Naperville, Ill. 60563 as NALCO® 1450.

A cationic dispersion copolymer comprising about 10 mole % DMAEA.MCQ and about 90 mole % AcAm can be synthesized by conducting the following procedure. To a two-liter resin reactor equipped with stirrer, temperature controller, and water cooled condenser, add 239.38 grams of a 48.1% solution of acrylamide (1.6199 moles), 21.63 grams of an 80.6% solution of DMAEA.MCQ (0.09001 moles), 260 grams of ammonium sulfate, 258.01 grams of deionized water, 18 grams of glycerol, 33.75 grams of a 16% solution of polyDADMAC (IV=1.5 dl/gm), 36 grams of a 20% solution of polyDMAEA.MCQ (IV=2.0 dl/gm), and 0.3 grams of EDTA. The mixture is heated to 48° C. and 0.50 grams of a 4% solution of 2,2' azobis(2-amidinopropane) dihydrochloride are added. The resulting solution is sparged with 1000 cc/min. of nitrogen. After 15 minutes, polymerization begins and the solution becomes viscous. Over the next 4 hours the temperature is maintained at 48° C. and a solution containing 79.79 grams (0.5399 moles) of 48.1% acrylamide, 36.04 grams (0.1500 moles) of an 80.6% solution of DMAEA.MCQ, 6 grams of glycerol and 0.1 gram of EDTA is pumped into the reactor using a syringe pump. To the resulting polymer dispersion are added 0.50 grams of a 4% solution of 2,2' azobis(2-amidinopropane) dihydrochloride. The dispersion is then further reacted for 2.5 hours at a temperature of 48° C. to 55° C. The resulting polymer dispersion has a Brookfield viscosity of about 7600 cps. 10 grams of 99% acetic acid and 20 grams of sodium sulfate are added to the above dispersion. The resulting dispersion has a Brookfield viscosity of about 2100 cps and contains 20% of a copolymer comprising about 90 mole % acrylamide and about 10 mole percent DMAEA.MCQ. This copolymer has an intrinsic viscosity of 15.5 dl/gm in 0.125 molar $NaNO_3$. This copolymer has a RSV of about 21.4 dl/grams.

A cationic dispersion copolymer comprising about 10 mole % DMAEA.MCQ and about 90 mole % AcAm can be purchased from Nalco Chemical Company, One Nalco Center, Naperville, Ill. 60563 as NALCO® 1460.

A cationic dispersion copolymer comprising about 20 mole % DMAEA.MCQ and about 80 mole % AcAm can be synthesized by conducting the following procedure. To a two-liter resin reactor equipped with stirrer, temperature controller, and water cooled condenser, add 136.03 grams of a 48.1% solution of acrylamide (0.9205 moles), 37.12 grams of an 80.6% solution of DMAEA.MCQ (0.1545 moles), 190 grams of ammonium sulfate, 50 grams of sodium sulfate, 267.99 grams of deionized water, 13.2 grams of glycerol, 33.75 grams of a 16% solution of polyDADMAC (IV=1.5 dl/gm), 45 grams of a 20% solution of polyDMAEA.MCQ (IV=2.0 dl/gm), and 0.2 grams of EDTA. The mixture is heated to 48° C. and 0.50 grams of a 4% solution of 2,2' azobis(2-amidinopropane) dihydrochloride are added. The resulting solution is sparged with 1000 cc/min. of nitrogen. After 15 minutes, polymerization began and the solution becomes viscous. Over the next 4 hours the temperature is maintained at 48° C. and a solution containing 111.29 grams of 48.1% acrylamide, 63.47 grams (0.2641 moles) of an 80.6% solution of DMAEA.MCQ, 10.8 grams of glycerol and 0.2 grams of EDTA is pumped into the reactor using a syringe pump. To the resulting polymer dispersion are added 0.50 grams of a 4% solution of 2,2' azobis(2-amidinopropane) dihydrochloride. The dispersion is then further reacted for 2.5 hours at a temperature of 48° C. to 55° C. The resulting polymer dispersion has a Brookfield viscosity of about 2160 cps. 10 grams of 99% adipic acid and 30 grams of ammonium sulfate are added to the above dispersion. The resulting dispersion has a Brookfield viscosity of 1325 cps and contains 20% of copolymer comprising about 80 mole % acrylamide and about 20 mole % DMAEA.MCQ. This copolymer has an intrinsic viscosity of about 13.7 dl/gm in 0.125 molar $NaNO_3$.

Regarding what is an effective dosage of the cationic dispersion copolymer to add to the papermaking slurry, there does not appear to be a maximum dosage at which the amount of cationic dispersion copolymer present adversely affects the system. The cationic dispersion copolymer is preferably added in an amount of from about 0.5 ppm to about 1000 ppm. More preferably, the amount of the cationic dispersion copolymer added is from about 0.5 ppm to about 100 ppm, with 100 ppm being about the highest dose that would be effective on a cost basis. Most preferably, the amount of the cationic dispersion copolymer added is from about 2 ppm to about 40 ppm. The most highly preferable amount of cationic dispersion copolymer added is from about 4 ppm to about 25 ppm.

The cationic dispersion copolymer is preferably added to the system in neat form. However, the cationic dispersion copolymer should become substantially dispersed within the slurry before formation of the paper product. Therefore, under certain circumstances, the cationic dispersion copolymer is added to the slurry in an aqueous medium, for instance as a water solution or dispersing, to facilitate the dispersion of the polymer of the slurry.

The next step in the process is to shear the slurry. Shearing of the slurry is a unit operation that is well known within the papermaking art. Shearing generally is accomplished by the cleaning, mixing and pumping stages of the papermaking process.

The next step in the process is to add a microparticle selected from the group consisting of i) copolymers of acrylic acid and acrylamide;

ii) bentonite; and iii) dispersed silica,

Copolymers of acrylic acid and acrylamide useful as microparticles in this application include: a copolymer of acrylic acid and acrylamide sold under the trademark Nalco® 8677 PLUS, which is available from Nalco Chemical Company. Other copolymers of acrylic acid and acrylamide which can be used are described in U.S. Pat. No. 5,098,520, which is herein incorporated by reference.

Bentonites useful as the microparticle for this process include: any of the materials commercially referred to as bentonites or as bentonite-type clays, i.e., anionic swelling clays such as sepialite, attapulgite and montmorillinite. In addition to those bentonites already listed, bentonites as described in U.S. Pat. No. 4,305,781 are suitable for use in the process of the instant claimed invention. The preferred bentonite is a hydrated suspension of powdered bentonite in water. Powdered bentonite is available as Nalbrite™, from Nalco Chemical Company.

Dispersed silicas useful in this application have an average particle size ranging between about 1–100 nanometers (nm), preferably having a particle size ranging between 2–25 nm, and most preferably having a particle size ranging between about 2–15 nm. The dispersed silica, may be in the form of colloidal, silicic acid, silica sols, fumed silica, agglomerated silicic acid, silica gels, and precipitated silicas, as long as the particle size or ultimate particle size is within the ranges mentioned above. Dispersed silica in water with a typical particle size of 4 nm is available as Nalco® 8671, from Nalco Chemical Company.

The next step in the process is draining the slurry to form a sheet; and the final step in the process is drying the sheet to form a paper sheet. Both of these papermaking process steps are well known within the art of papermaking.

The conclusion reached as result of this work, is that the use of the above described cationic dispersion copolymers with the above-described microparticles is effective in improving the retention and drainage of a papermaking process.

The following examples are intended to be illustrative of the present invention and to teach one of ordinary skill in the art how to make and use the invention. These examples are not intended to limit the invention or its protection in any way.

EXAMPLES

In all of these examples, terms used throughout have the following meanings.

Polymers

Polymer A is a cationic dispersion copolymer comprising about 10 mole % DMAEA.BCQ and about 90 mole % AcAm with a RSV of about 19.6 dl/g. Polymer A is available as Nalco® 1450, from the Nalco Chemical Company.

Polymer B is a cationic dispersion copolymer comprising about 10 mole % DMAEA.MCQ and about 90 mole % AcAm with a RSV of about 21.4 dl/g. Polymer B is available as Nalco®1460, from Nalco Chemical Company.

Polymer C is a cationic dispersion copolymer comprising about 20 mole % DMAEA.MCQ and about 80 mole % AcAm with a RSV of about 27.6 dl/g. Polymer C can be made by the previously described procedure.

Polymer D is a cationic latex copolymer comprising about 10 mole % DMAEA.MCQ and about 90 mole % AcAm with a RSV of about 19.7 dl/g. Polymer D is available as Nalco®7530 from Nalco Chemical Company. Throughout this patent application, any data given for the use of Polymer D in the instant claimed process is to be considered a comparative example, not an example of the instant claimed invention.

Microparticles

Microparticle A is a dispersed silica in water with a typical particle size of 4 nm.; available as Nalco® 8671, from Nalco Chemical Company.

Microparticle B is a copolymer of acrylic acid and acrylamide; available as Nalco® 8677 PLUS from Nalco Chemical Company.

Microparticle C is a hydrated suspension of powdered bentonite in water. Powdered bentonite is available as Nalbrite™ from Nalco Chemical Company.

Britt Jar Test

The Britt Jar Test employed in Examples 1 to 3 used a Britt CF Dynamic Drainage Jar developed by K. W. Britt of New York State University, which generally consists of an upper chamber of about 1 liter capacity and a bottom drainage chamber, the chamber being separated by a support screen and a drainage screen. Below the drainage chamber is a downward extending flexible tube equipped with a clamp for closure. The upper chamber is provided with a variable speed, high torque motor equipped with a 2-inch 3-bladed propeller to create controlled shear conditions in the upper chamber. The test was conducted by placing the cellulosic stock in the upper chamber and then subjecting the stock to the following sequence:

| Time | Action |
|---|---|
| 0 seconds | Commence shear stirring at 750 rpm, (add starch, if needed). |
| 10 seconds | Add the cationic polymer, increase speed to 2000 rpm. |

-continued

| Time | Action |
|---|---|
| 40 seconds | Reduce shear stirring to 750 rpm. |
| 50 seconds | Add the microparticle. |
| 60 seconds | Open the tube clamp to commence drainage, and continue drainage for 30 seconds. |

The material so drained from the Britt jar (the "filtrate") is collected and diluted with water to one-fourth of its initial volume. The turbidity of such diluted filtrate, measured in Formazin Turbidity Units or FTU's, is then determined. The turbidity of such a filtrate is inversely proportional to the papermaking retention performance; the lower the turbidity value, the higher is the retention of filler and/or fines. The turbidity values were determined using a Hach Spectrophotometer, model DR2000.

The turbidity values (in FTU) that were determined were converted to (Percent Improvement) values using the formula:

$$\text{Percent Improvement}=100\times(\text{Turbidity}_u-\text{Turbidity}_t)/\text{Turbidity}_u$$

where $\text{Turbidity}_u$ is the turbidity reading result for the blank for which no polymer or microparticle, and wherein $\text{Turbidity}_t$ is the turbidity reading result of the test using polymer, or polymer and microparticle.

Filtration Test

The filtration tests used in Examples 1 to 8 measured the drainage (water removal) rate of the test stock subjected to the various chemical treatments. A filtration cell, mounted upright on a stand, was used. The capacity of this cell is about 220 milliliters. A 200 mesh drainage screen (76 $\mu$m screen with 8% opening) served as the filter medium. The stock was filtered by gravity. The filtrate was collected in a cup placed on a weighing balance below the cell. This balance was interfaced with a computer so that the displayed weight was recorded continuously over time. The computer automatically recorded the change of weight over time.

The cellulosic stock was treated in the aforementioned Britt jar. The treated stock was transferred to the cell and filtered until completion. The rate of filtrate collection is an indication of the drainage performance; the higher the filtrate collection rate, the higher is the improvement in drainage.

Test Stocks

Alkaline Test Stock Made From Chemical Pulp

The cellulosic slurry used in Example 1, Example 2, Example 3, and Example 8 was comprised of 70 weight percent fiber and 30 weight percent filler, diluted to an overall consistency of 0.5 percent with formulation water. The fiber was a 60/40 blend by weight of bleached hardwood kraft (sulfate chemical pulp) and bleached softwood kraft (sulfate chemical pulp), separately beaten to a Canadian Freeness value range of from 320 to 360 C.F.S.

To this slurry was added a mineral filler. The filler was a commercial calcium carbonate, provided in dry form. The formulation water contained 60 ppm calcium hardness (added as $CaCl_2$), 18 ppm magnesium hardness (added as $MgSO_4$) and 134 ppm bicarbonate alkalinity (added as $NaHCO_3$). The pH of the final thin stock (cellulosic slurry plus filler and other additives equals a "stock") was pH 7.2.

Acid Test Stock From Chemical Pulp

The cellulosic slurry used in Example 4 and Example 5 was comprised of 93 weight percent fiber and 7 weight percent filler, diluted to an overall consistency of 0.54 percent with formulation water. The fiber was a 50/50 blend by weight of bleached hardwood kraft (sulfate chemical pulp) and bleached softwood kraft (sulfate chemical pulp), separately beaten to a Canadian Freeness value range of from 320 to 360 C.F.S.

To this slurry was added mineral fillers. The mineral fillers were clay as predispersed kaolin and titanium dioxide, commercially provided in dry form. The pH was adjusted to pH 4.00 using dilute sulfuric acid, following which alum (0.005% of final slurry) and sizing agent rosin (0.0025 wt % of final slurry) were added. The formulation water contained 60 ppm calcium hardness (added as $CaCl_2$), 18 ppm magnesium hardness (added as $MgSO_4$) and 134 ppm bicarbonate alkalinity (added as $NaHCO_3$).

Corrugated Coated Test Stock From Recycle Pulp

The stock used in Example 6 and Example 7 was obtained as thick stock (consistency of 4.11%) from a paper mill. The stock contained a recycle pulp with the components of the recycle pulp being a mixture of old corrugated cardboard (OCC), newsprint, and boxboard. No mineral filler or other additives were added to this stock. The stock, as obtained, was diluted to an overall consistency of 0.8% with formulation water containing 60 ppm calcium hardness (added as $CaCl_2$), 18 ppm magnesium hardness (added as $MgSO_4$) and 134 ppm bicarbonate alkalinity ( added as $NaHCO_3$). The final pH of the thin stock was pH 6.5. The percent ash of the thin stock was 7.3 wt %.

In all of these examples, the activity of the system is measured, and presented. The data is presented sometimes in Tabular form as percent improvement in Retention. Sometimes the data is illustrated in the Figures, in terms of rate of drainage with rate of drainage being the slope of the line in each figure with slope being filtrate weight collected per unit of time.

Example 1

Using the alkaline test stock described above, the Britt jar test, also described above was employed to determine the retention performances of Polymer A(dispersion) in comparison to Polymer D (latex), with Microparticle A as the microparticle. In each test, cationic potato starch was charged to the test stock in the amount of 10 lb/ton of dry weight of slurry solids. The various systems tested are shown below in Table 1. The test results are reported in Table 1 below as diluted filtrate turbidity values (FTU) and (Percent Improvement), as defined earlier, for each of the systems tested.

TABLE I

Britt Jar Retention Tests Alkaline Furnish

| No. | Polymer | Polymer Dosage lb/ton | Microparticle A Dosage lb/ton | Turbidity (FTU) | Percent Improvement |
|---|---|---|---|---|---|
| i | blank | 0 | 0 | 359.5 | not applicable |
| 1 | A | 1.6 | 0 | 289 | 20 |
| 2 | A | 1.6 | 2 | 84 | 77 |
| 3 | D | 1.6 | 0 | 291 | 19 |
| 4 | D | 1.6 | 2 | 162 | 55 |

The drainage performance of these systems was measured for the same alkaline furnish using the filtration test described above. In each test starch was charged to the test stock in the amount of 10 lb/ton of dry weight of slurry solids. The results are shown for each of the systems tested in FIG. 1 as graphs of collected filtrate weight versus time. In FIG. 1, the filtration rate results show that the combination of Polymer A and Microparticle A, outperformed any other combination—including Polymer A by itself, Polymer D by itself and Polymer D and Microparticle A together.

Example 2

Using the alkaline test stock described above, the Britt jar test, also described above was employed to determine the retention performances of Polymer B (dispersion) in comparison to Polymer D (latex), with Microparticle A as the microparticle. In each test, cationic potato starch was charged to the test stock in the amount of 10 lb/ton of dry weight of slurry solids. The various systems tested are shown below in Table 2. The test results are reported in Table 2 below as diluted filtrate turbidity values (FTU) and (Percent Improvement), as defined earlier, for each of the systems tested.

TABLE II

Britt Jar Retention Tests Alkaline Furnish

| No. | Polymer | Polymer Dosage lb/ton | Microparticle A Dosage lb/ton | Turbidity (FTU) | Percent Improvement |
|---|---|---|---|---|---|
| i | blank | 0 | 0 | 359.5 | not applicable |
| 1 | B | 1.6 | 0 | 252 | 30 |
| 2 | B | 1.6 | 2 | 74 | 79 |
| 3 | D | 1.6 | 0 | 291 | 19 |
| 4 | D | 1.6 | 2 | 162 | 55 |

The percent improvements in turbidity are based on the control (blank) experiment with no additives (experiment number "i" in both Tables I and II). In the control experiments with polymer but no microparticles (#1 and #3 in Table I; #1 and #3 in Table II) polymer A(dispersion) and polymer D(latex) show comparable activity (20% and 19%) and polymer B (dispersion) is slightly but significantly better (30%). Systems with the dispersion polymers and microparticle (#2 in Table I; #2 in Table II) are significantly better than systems with the latex polymer (#4 in Table I; #4 in Table II), 77% and 79% improvement vs. 55% improvement with the latex polymer. This result was unexpected, as the Polymer B (dispersion) and Polymer D (latex) are both the same chemistry and molecular weight (as described using RSV).

Figure 2:
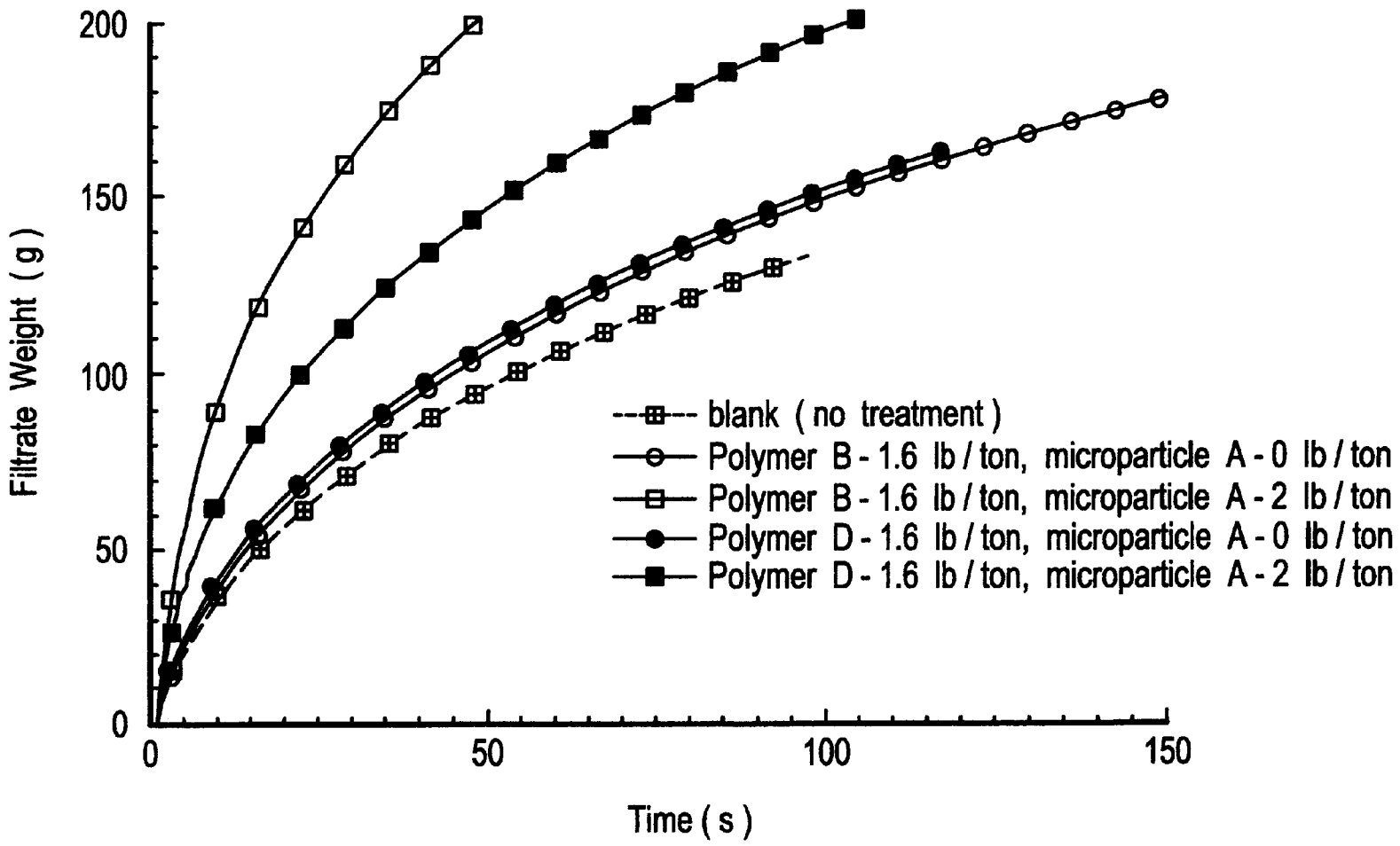
FIG. 2 is a plot of Filtrate Weight vs. Time for an alkaline test stock in which Polymer B and Polymer D are compared, with and without the addition of Microparticle A.

The drainage performance of these systems was measured for the same alkaline furnish ("stock" plus other additives is referred to as "furnish") using the filtration test described above. In each test starch was charged to the test stock in the amount of 10 lb/ton of dry weight of slurry solids. The results are shown for each of the systems tested in FIG. 2 as graphs of collected filtrate weight versus time. In FIG. 2, the filtration rate results show that the combination of Polymer B and Microparticle A, outperformed any other combination—including Polymer B by itself, Polymer D by itself, and Polymer D and Microparticle A used together.

Example 3

Using the alkaline test stock described above, the Britt jar test, also described above was employed to determine the retention performances of Polymer C (dispersion) in comparison to Polymer D (latex), with Microparticle A as the microparticle. In each test, cationic potato starch was charged to the test stock in the amount of 10 lb/ton of dry weight of slurry solids. The various systems tested are shown below in Table 3. The test results are reported in Table 3 below as diluted filtrate turbidity values (FTU) and (Percent Improvement), as defined earlier, for each of the systems tested.

TABLE III

Britt Jar Retention Tests Alkaline Furnish

| No. | Polymer | Polymer Dosage lb/ton | Microparticle A Dosage lb/ton | Turbidity (FTU) | Percent Improvement |
|---|---|---|---|---|---|
| i | blank | 0 | 0 | 359.5 | not applicable |
| 1 | C | 1.6 | 0 | 266 | 26 |
| 2 | C | 1.6 | 2 | 120 | 67 |
| 3 | D | 1.6 | 0 | 291 | 19 |
| 4 | D | 1.6 | 2 | 162 | 55 |

Example 4

Figure 3:
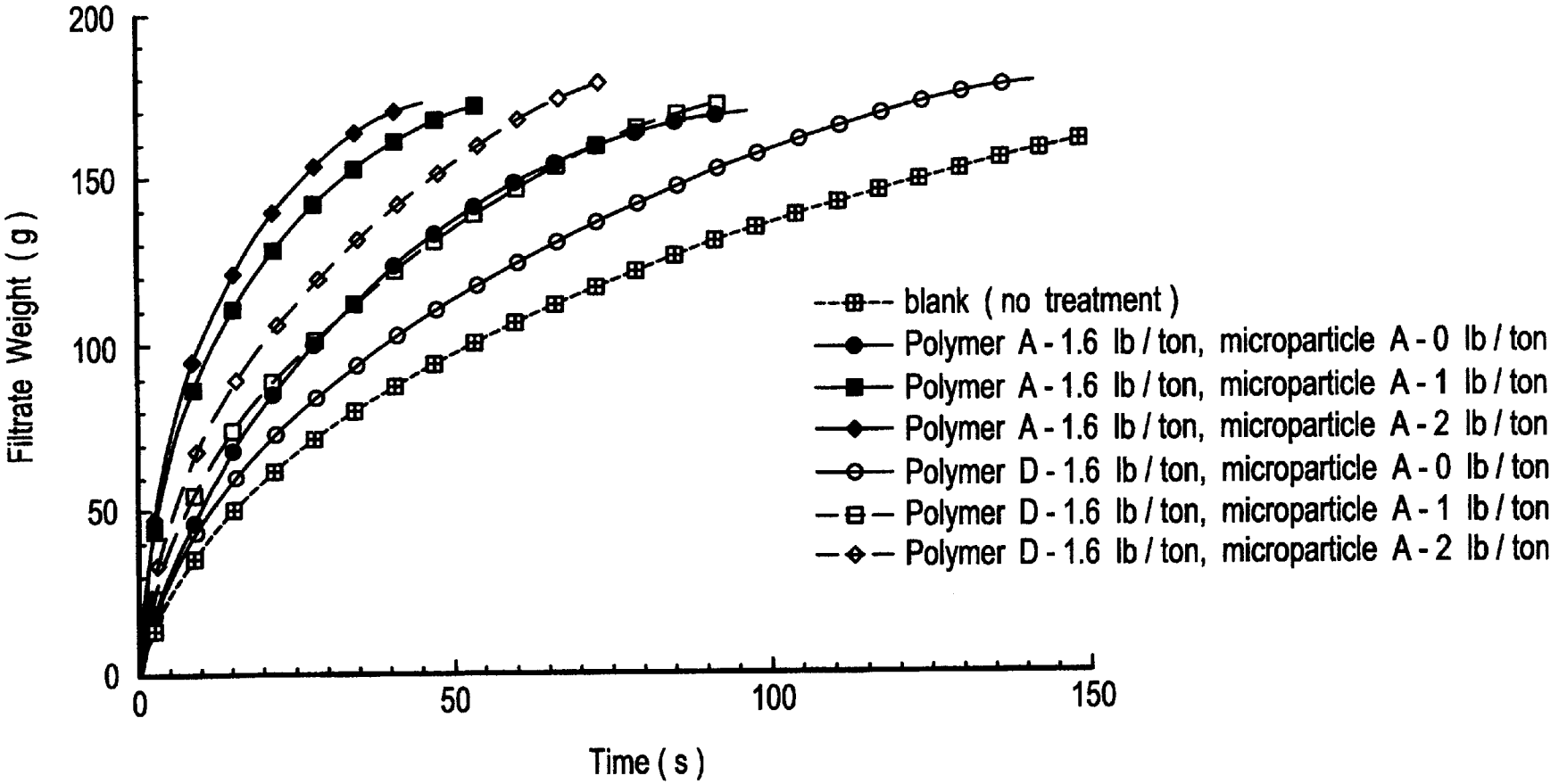
FIG. 3 is a plot of Filtrate Weight vs. Time for an acid test stock in which Polymer A and Polymer D are compared, with and without the addition of two different levels of Microparticle A.

Using the acid test stock described above, the filtration test, also described above was employed to determine the drainage performances of Polymer A (dispersion) in comparison to Polymer D (latex), with Microparticle A as the microparticle. The results are shown for each of the systems tested in FIG. 3 as graphs of collected filtrate weight versus time. In FIG. 3, the filtration rate results show that the combination of Polymer A and Microparticle A, outperformed any other combination—including Polymer A by itself, Polymer D by itself and Polymer D and Microparticle A used together.

Example 5

Figure 4:
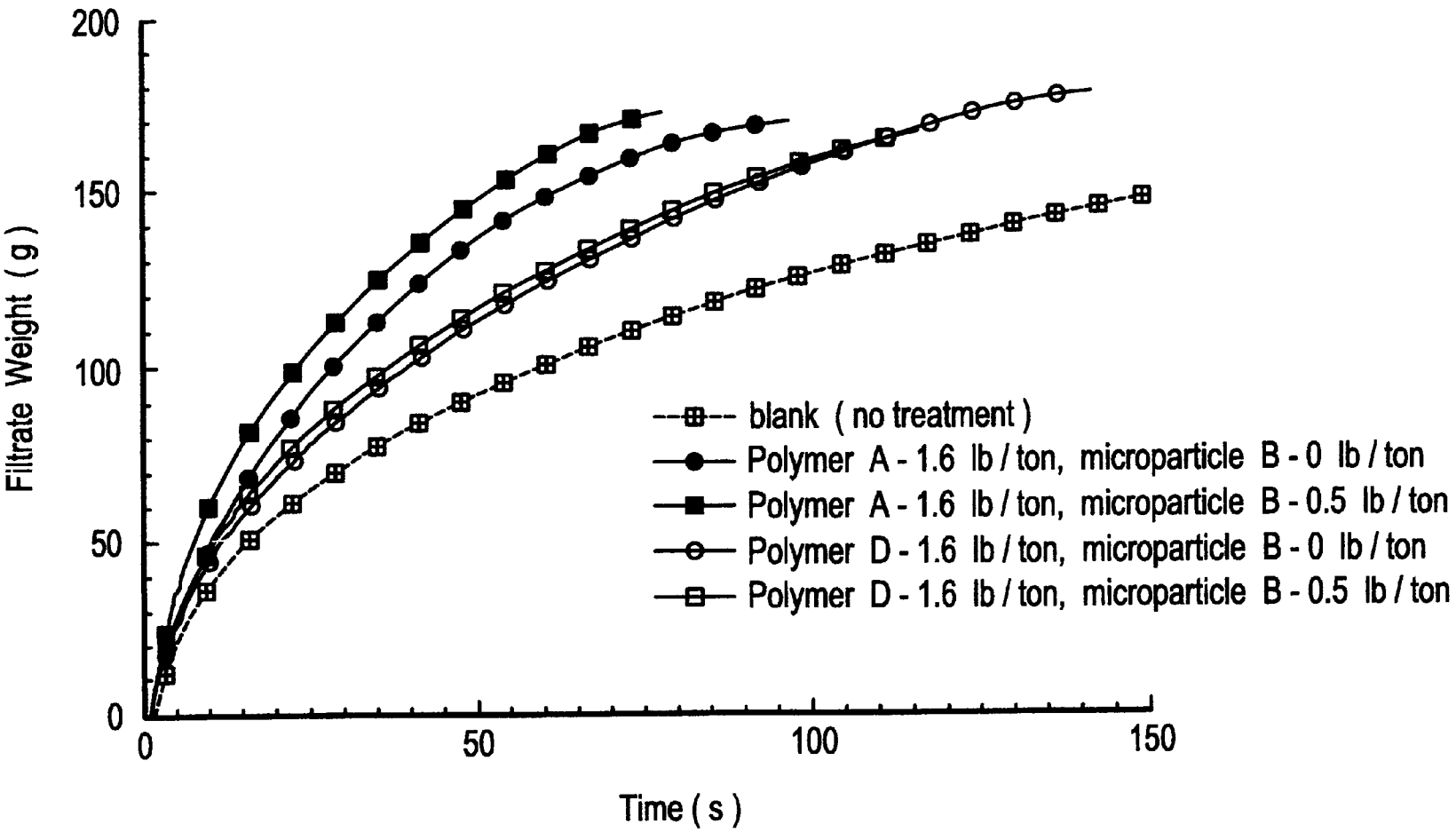
FIG. 4 is a plot of Filtrate Weight vs. Time for an acid test stock in which Polymer A and Polymer D are compared, with and without the addition of Microparticle B.

Using the acid test stock described above, the filtration test, also described above was employed to determine the drainage performances of Polymer A (MCQ dispersion copolymer) in comparison to Polymer D (BCQ latex copolymer), with Microparticle B as the microparticle. The results are shown for each of the systems tested in FIG. 4 as graphs of collected filtrate weight versus time. In FIG. 4, the filtration rate results show that the combination of Polymer A and Microparticle B, outperformed any other combination—including Polymer A by itself, polymer D by itself and polymer D and Microparticle B used together.

Example 6

Figure 5:
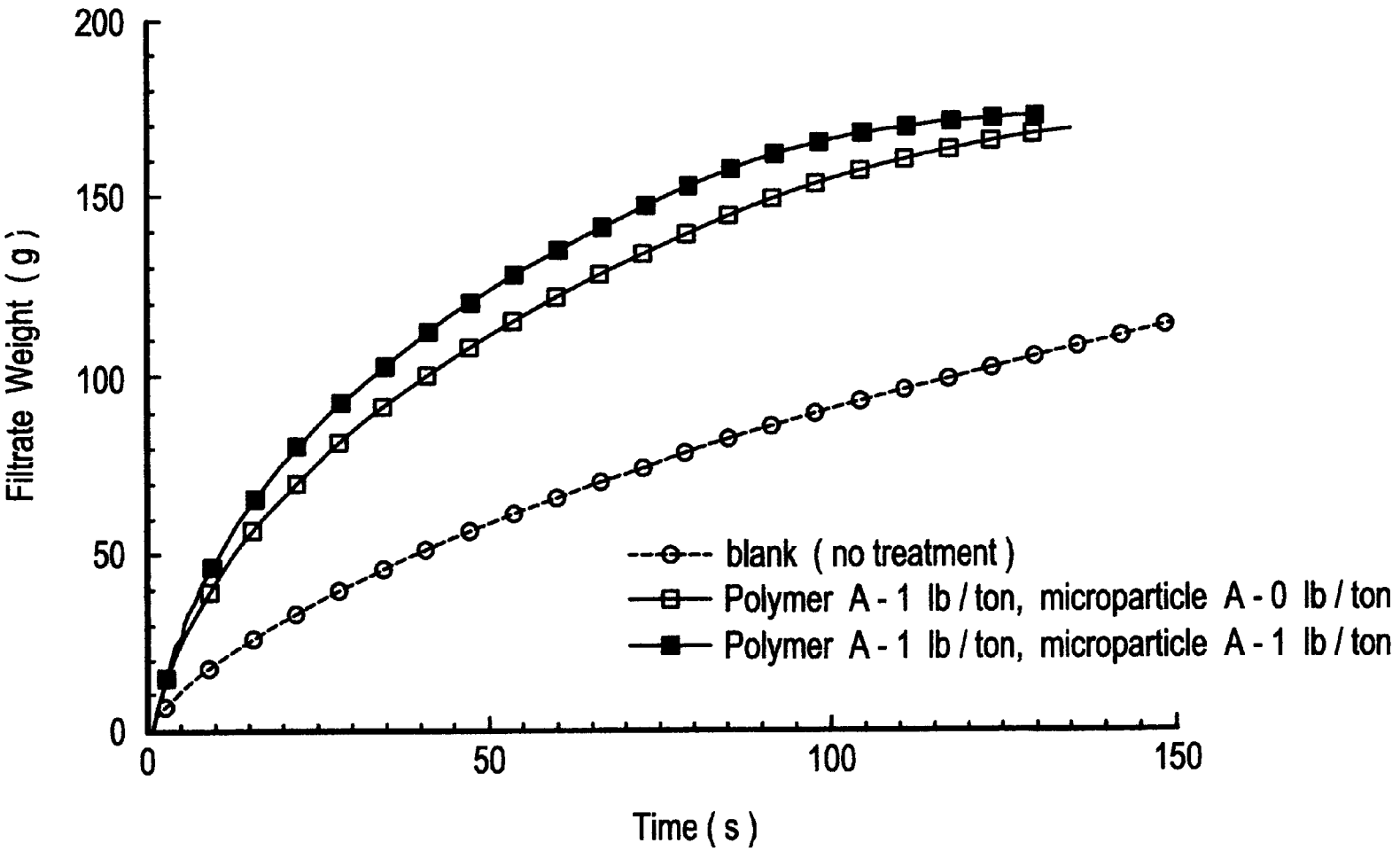
FIG. 5 is a plot of Filtrate Weight vs. Time for a corrugated coated test stock in which the effect of Polymer A is compared to no polymer being present and is also compared to Polymer A being present with Microparticle A.

Using the corrugated coated test stock described above, the filtration test, also described above was employed to determine the drainage performances of Polymer A (dispersion), with Microparticle A as the microparticle. The results are shown for each of the systems tested in FIG. 5 as graphs of collected filtrate weight versus time. In FIG. 5, the filtration rate results show that the combination of Polymer A(dispersion) and Microparticle A, outperformed Polymer A by itself and also outperformed "no treatment".

Example 7

Figure 6:
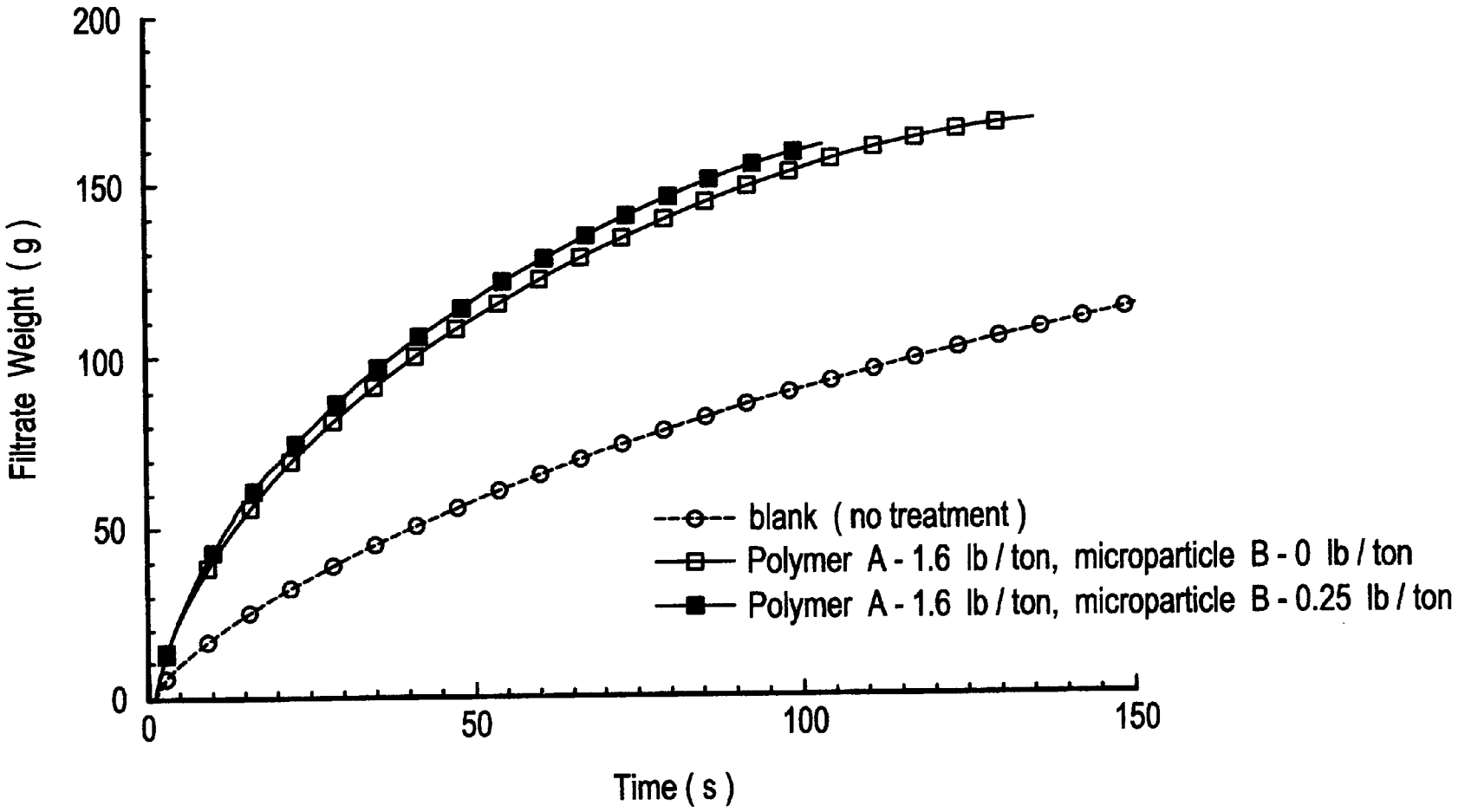
FIG. 6 is a plot of Filtrate Weight vs. Time for a corrugated coated test stock in which the effect of Polymer A is compared to no polymer being present and is also compared to Polymer A being present with Microparticle B.

Using the corrugated coated test stock described above, the filtration test, also described above was employed to determine the drainage performances of Polymer A (dispersion), with Microparticle B as the microparticle. The results are shown for each of the systems tested in FIG. 6 as graphs of collected filtrate weight versus time. In FIG. 6, the filtration rate results show that the combination of Polymer A and Microparticle B, outperformed Polymer A by itself and also outperformed "no treatment" whatsoever.

Example 8

Figure 7:
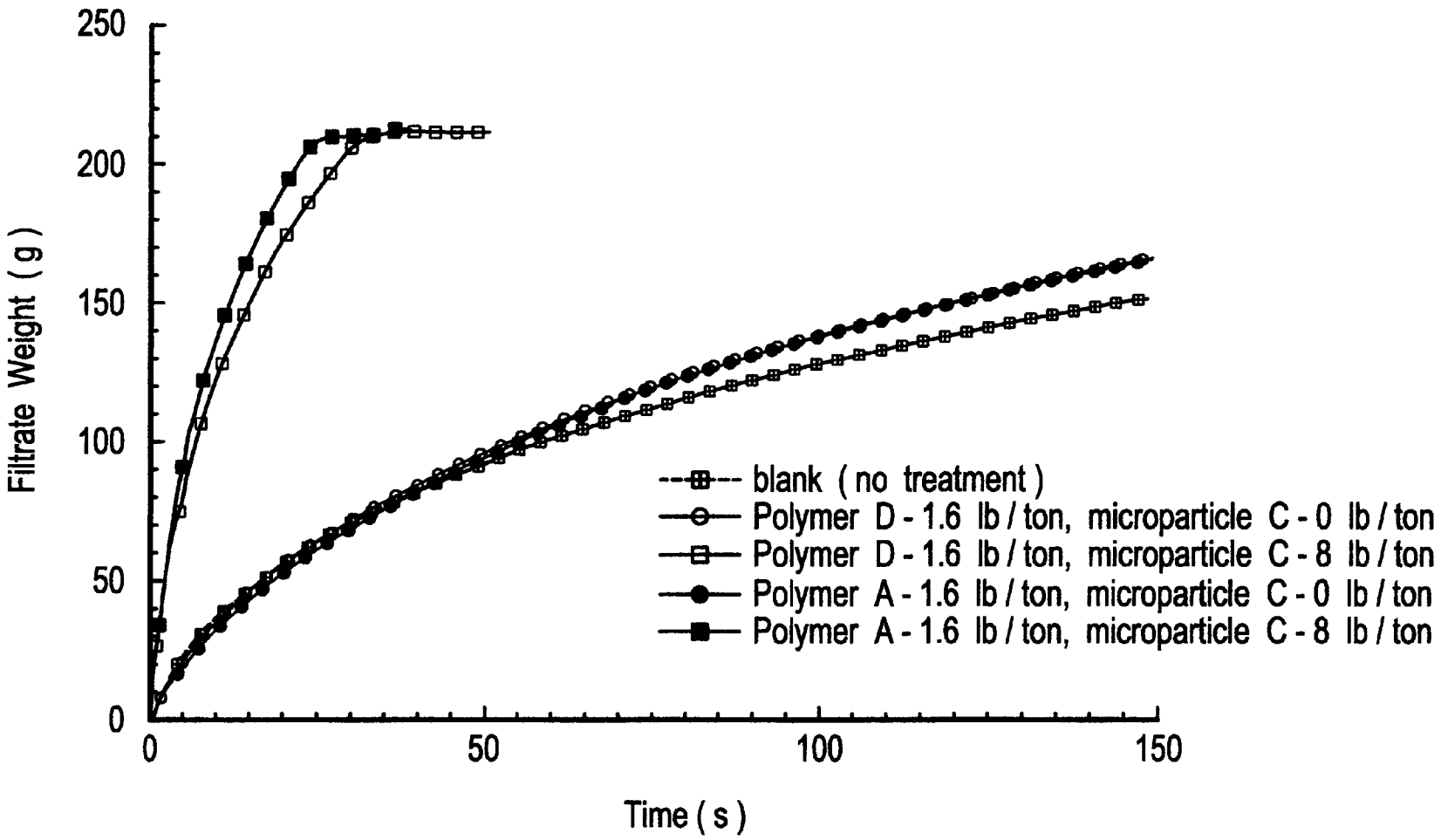
FIG. 7 is a plot of Filtrate Weight vs. Time for an alkaline test stock in which Polymer A and Polymer D are compared, with and without the addition of Microparticle C.

Using the alkaline test stock described above, the filtration test, also described above was employed to determine the drainage performances of Polymer A (dispersion) in comparison to Polymer D (latex), with Microparticle C as the microparticle. In each test, cationic potato starch was charged to the test stock in the amount of 10 lb/ton of dry weight of slurry solids. The results are shown for each of the systems tested in FIG. 7 as graphs of collected filtrate weight versus time. In FIG. 7, it is shown that the combination of Polymer A (dispersion) with Microparticle C had a greater filtration rate than the combination of Polymer D (latex) with Microparticle C.

The conclusion reached from these results is that when cationic dispersion polymers and microparticles are added to an aqueous papermaking slurry, they act to improve the retention and drainage properties. Furthermore, an unexpected result of this work is that certain cationic dispersion polymers are more active (in terms of improving retention and drainage) when combined with microparticles, than are comparable cationic latex polymers when combined with microparticles, under similar test conditions.

Changes can be made in the composition, operation and arrangement of the method of the present invention described herein without departing from the concept and scope of the invention as defined in the following claims:

We claim:

1. In a papermaking process consisting essentially of:

forming an aqueous cellulosic papermaking slurry;

adding to the slurry certain additives;

shearing the slurry;

draining the slurry to form a sheet; and drying the sheet to form a paper sheet;

the improvement comprising adding to the slurry, prior to it being sheared; from about 0.5 ppm to about 1,000 ppm of a cationic dispersion polymer; which cationic dispersion polymer is selected from a group of copolymers consisting of:

i) a copolymer of about 10 mole % DMAEA.BCQ and about 90 mole % AcAm;

ii) a copolymer of about 10 mole % DMAEA.MCQ and about 90 mole % AcAm; and iii) a copolymer of about 20 mole % DMAEA.MCQ and about 80 mole % AcAm; and adding to the slurry, after said cationic dispersion polymer is added and the slurry is sheared, a microparticle selected from the group consisting of from 0.25 lb/ton to 8 lb/ton, a) copolymers of acrylic acid and acrylamide;

b) bentonite; and c) dispersed silica.

2. The process of claim 1 wherein said cationic dispersion polymer is a copolymer of about 10 mole % DMAEA.BCQ and about 90 mole % AcAm.

3. The process of claim 1 wherein said cationic dispersion polymer is a copolymer of about 10 mole % DMAEA.MCQ and about 90 mole % AcAm.

4. The process of claim 1 wherein said cationic dispersion polymer is a copolymer of about 20 mole % DMAEA.MCQ and about 80 mole % AcAm.

5. The process of claim 2 wherein said microparticle is a copolymer of acrylic acid and acrylamide.

6. The process of claim 2 wherein said microparticle is bentonite.

7. The process of claim 2 wherein said microparticle is dispersed silica.

8. The process of claim 3 wherein said microparticle is a copolymer of acrylic acid and acrylamide.

9. The process of claim 3 wherein said microparticle is bentonite.

10. The process of claim 3 wherein said microparticle is dispersed silica.

11. The process of claim 2 wherein said cationic dispersion polymer has a RSV of about 19.6 dl/g.

12. The process of claim 3 wherein said cationic dispersion polymer has a RSV of about 21.4 dl/g.

13. The process of claim 4 wherein said cationic dispersion polymer has a RSV of about 27.6 dl/g.

14. The process of claim 1 wherein said aqueous cellulose papermaking slurry comprises pulps which pulps are selected from the group consisting of chemical pulps, including sulfate and sulfite pulps from both hard and soft woods; thermo-mechanical pulps; mechanical pulps; recycle pulps and ground wood pulps.

15. The process of claim 2 wherein said aqueous cellulose papermaking slurry comprises pulps which pulps are selected from the group consisting of chemical pulps and recycle pulps.

16. The process of claim 3 wherein said aqueous cellulose papermaking slurry comprises pulps which pulps are selected from the group consisting of chemical pulps and recycle pulps.

17. The process of claim 4 wherein said aqueous cellulose papermaking slurry comprises pulps which pulps are selected from the group consisting of chemical pulps and recycle pulps.

18. The process of claim 1 wherein one of said certain additives is a mineral filler is selected from the group consisting of titanium dioxide, clay, talc, calcium carbonate and combinations thereof.

19. The process of claim 18 wherein the mineral filler is added to the slurry in an amount of from about 2 to about 50 parts per hundred parts by weight of dry pulp contained in the slurry.

20. The process of claim 1 in which one of said certain additives is a coagulant selected from the group consisting of low molecular weight cationic synthetic polymers, starch and alum.

21. The process of claim 20 in which said coagulant is starch.

* * * * *